US009564015B2

(12) United States Patent
Arnone et al.

(10) Patent No.: US 9,564,015 B2
(45) Date of Patent: Feb. 7, 2017

(54) SKILL NORMALIZED HYBRID GAME

(71) Applicants: Miles Arnone, Sherborn, MA (US); Frank Cire, Pasadena, CA (US); Eric Meyerhofer, Pasadena, CA (US)

(72) Inventors: Miles Arnone, Sherborn, MA (US); Frank Cire, Pasadena, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 14/162,735

(22) Filed: Jan. 23, 2014

(65) Prior Publication Data

US 2014/0141863 A1 May 22, 2014

Related U.S. Application Data

(63) Continuation of application No. PCT/US2012/060600, filed on Oct. 17, 2012.

(Continued)

(51) Int. Cl.
*G07F 17/32* (2006.01)

(52) U.S. Cl.
CPC ..... *G07F 17/326* (2013.01); *G07F 17/3244* (2013.01); *G07F 17/3267* (2013.01); *G07F 17/3295* (2013.01)

(58) Field of Classification Search
None
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 A 10/2001
JP 2003111980 A 4/2003

(Continued)

OTHER PUBLICATIONS

ITL.NIST.GOV, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

(Continued)

*Primary Examiner* — Jason Skaarup
(74) *Attorney, Agent, or Firm* — Frank Cire

(57) ABSTRACT

Systems and methods in accordance with embodiments of the invention operate a skill normalized hybrid game. One embodiment includes a skill normalized hybrid game, including: a gambling game; an entertainment game; a game world engine constructed to manage the entertainment game and communicate gameplay gambling event occurrences based upon a player's skillful execution of the entertainment game that trigger randomly generated payouts for the gambling game to the gambling game; and a skill normalization module constructed to: receive player performance measurements for at least one player from the game world engine; assign a handicap to the at least one player based at least in part upon the performance measurements for the at least one player from the game world engine; and send information concerning handicaps to the game world engine that configures the game world engine to implement each assigned handicap within the skill normalized hybrid game.

10 Claims, 11 Drawing Sheets

Related U.S. Application Data

(60) Provisional application No. 61/627,737, filed on Oct. 17, 2011, provisional application No. 61/630,204, filed on Dec. 6, 2011.

(56) References Cited

U.S. PATENT DOCUMENTS 5,785,592 A 7/1998 Jacobsen
6,050,895 A 4/2000 Luciano
6,227,974 B1 5/2001 Eilat
6,267,669 B1 7/2001 Luciano
6,712,693 B1 3/2004 Hettinger
6,761,632 B2 7/2004 Nolz et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung et al.
7,753,770 B2 7/2010 Walker et al.
7,753,790 B2 7/2010 Nguyen
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,998,707 B2 * 4/2015 Arnone ..... G07F 17/32 463/25
9,251,657 B2 * 2/2016 Arnone ..... A63F 9/24
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0027639 A1 * 2/2003 Peterson et al. ..... 463/42
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0234791 A1 10/2006 Nguyen et al.
2006/0258433 A1 11/2006 Finocchio et al.
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0112706 A1 * 5/2007 Herbrich et al. ..... 706/21
2007/0117641 A1 5/2007 Walker et al.
2007/0129149 A1 6/2007 Walker
2007/0156509 A1 7/2007 Jung et al.
2007/0167212 A1 7/2007 Nguyen
2007/0167239 A1 7/2007 0'Rourke
2007/0191104 A1 8/2007 Van Luchene
2007/0203828 A1 8/2007 Jung et al.
2007/0265063 A1 * 11/2007 McNally ..... 463/23
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108425 A1 5/2008 Oberberger
2008/0119283 A1 5/2008 Baerlocher
2008/0146308 A1 6/2008 Okada
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0082093 A1 3/2009 Okada
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0221355 A1 9/2009 Dunaevsky et al.
2009/0247272 A1 10/2009 Abe
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0035674 A1 2/2010 Slomiany
2010/0056247 A1 3/2010 Nicely
2010/0062836 A1 3/2010 Young
2010/0093420 A1 4/2010 Wright
2010/0120525 A1 5/2010 Baerlocher et al.
2010/0124983 A1 5/2010 Gowin et al.
2010/0137047 A1 6/2010 Englman et al.

(56) References Cited

U.S. PATENT DOCUMENTS

| | | | |
|---|---|---|---|
| 2010/0174593 | A1 | 7/2010 | Cao |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0109454 | A1 | 5/2011 | McSheffrey |
| 2011/0111837 | A1 | 5/2011 | Gagner |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0202587 | A1 | 8/2012 | Allen |
| 2012/0322545 | A1 | 12/2012 | Arnone et al. |
| 2013/0059308 | A1 | 3/2013 | Makarova et al. |

FOREIGN PATENT DOCUMENTS

| | | | |
|---|---|---|---|
| JP | 2004097610 | A | 4/2004 |
| JP | 2004166746 | A | 6/2004 |
| JP | 2005-27950 | A | 2/2005 |
| WO | 9851384 | A1 | 11/1998 |
| WO | 2010087090 | A1 | 8/2010 |
| WO | 2011109454 | A1 | 9/2011 |
| WO | WO 2011109454 | A1 * | 9/2011 |
| WO | 2012139083 | A1 | 10/2012 |

OTHER PUBLICATIONS

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

WIPO—ISA, International Search Report and Written Opinion, PCT/US12/60600, Apr. 22, 2013.

WIPO—IPEA, International Preliminary Report on Patentability (with annexes), PCT/US12/60600, Aug. 1, 2013.

Japan Patent Office, First Office Action, Japan Patent Application No. 2014-535994, Jun. 1, 2015, Japan.

IP Australia, Patent Examination Report No. 2, Patent Application No. 2012326266, Apr. 27, 2015.

* cited by examiner

300

400

| N | 10% | 7.5% | 5% | 2.5% | 1% | | N | 10% | 7.5% | 5% | 2.5% | 1% |
|---|---|---|---|---|---|---|---|---|---|---|---|---|
| 3 | 1.15 | 1.15 | 1.15 | 1.15 | 1.15 | | 53 | | | 2.981 | 3.151 | |
| 4 | 1.42 | 1.44 | 1.46 | 1.48 | 1.49 | | 54 | | | 2.983 | 3.153 | |
| 5 | 1.60 | 1.64 | 1.67 | 1.71 | 1.75 | | 55 | | | 2.995 | 3.165 | |
| 6 | 1.73 | 1.77 | 1.82 | 1.89 | 1.94 | | 56 | | | 3.002 | 3.172 | |
| 7 | 1.83 | 1.88 | 1.94 | 2.02 | 2.10 | | 57 | | | 3.009 | 3.179 | |
| 8 | 1.91 | 1.96 | 2.03 | 2.13 | 2.22 | | 58 | | | 3.016 | 3.186 | |
| 9 | 1.98 | 2.04 | 2.11 | 2.21 | 2.32 | | 59 | | | 3.023 | 3.193 | |
| 10 | 2.03 | 2.10 | 2.18 | 2.29 | 2.41 | | 60 | | | 3.030 | 3.200 | |
| 11 | 2.09 | 2.14 | 2.23 | 2.36 | 2.48 | | 61 | | | 3.036 | 3.206 | |
| 12 | 2.13 | 2.20 | 2.29 | 2.41 | 2.55 | | 62 | | | 3.042 | 3.212 | |
| 13 | 2.17 | 2.24 | 2.33 | 2.46 | 2.61 | | 63 | | | 3.048 | 3.218 | |
| 14 | 2.21 | 2.28 | 2.37 | 2.51 | 2.66 | | 64 | | | 3.054 | 3.224 | |
| 15 | 2.25 | 2.32 | 2.41 | 2.55 | 2.71 | | 65 | | | 3.060 | 3.230 | |
| 16 | 2.28 | 2.35 | 2.44 | 2.59 | 2.75 | | 66 | | | 3.066 | 3.236 | |
| 17 | 2.31 | 2.38 | 2.47 | 2.62 | 2.79 | | 67 | | | 3.072 | 3.242 | |
| 18 | 2.34 | 2.41 | 2.50 | 2.65 | 2.82 | | 68 | | | 3.078 | 3.248 | |
| 19 | 2.36 | 2.44 | 2.53 | 2.68 | 2.85 | | 69 | | | 3.084 | 3.254 | |
| 20 | 2.39 | 2.46 | 2.56 | 2.71 | 2.88 | | 70 | | | 3.090 | 3.260 | |
| 21 | | | 2.58 | 2.73 | 2.91 | | 71 | | | 3.095 | 3.265 | |
| 22 | | | 2.60 | 2.76 | 2.94 | | 72 | | | 3.100 | 3.270 | |
| 23 | | | 2.62 | 2.78 | 2.96 | | 73 | | | 3.105 | 3.275 | |
| 24 | | | 2.64 | 2.80 | 2.99 | | 74 | | | 3.110 | 3.280 | |
| 25 | | | 2.66 | 2.82 | 3.01 | | 75 | | | 3.115 | 3.285 | |
| 26 | | | 2.680 | 2.840 | | | 76 | | | 3.120 | 3.290 | |
| 27 | | | 2.700 | 2.860 | | | 77 | | | 3.125 | 3.295 | |
| 28 | | | 2.720 | 2.880 | | | 78 | | | 3.130 | 3.300 | |
| 29 | | | 2.730 | 2.900 | | | 79 | | | 3.135 | 3.305 | |
| 30 | | | 2.750 | 2.910 | | | 80 | | | 3.140 | 3.310 | |
| 31 | | | 2.760 | 2.930 | | | 81 | | | 3.144 | 3.314 | |
| 32 | | | 2.780 | 2.950 | | | 82 | | | 3.148 | 3.318 | |
| 33 | | | 2.790 | 2.960 | | | 83 | | | 3.152 | 3.322 | |
| 34 | | | 2.810 | 2.970 | | | 84 | | | 3.156 | 3.326 | |
| 35 | | | 2.830 | 2.980 | | | 85 | | | 3.160 | 3.330 | |
| 36 | | | 2.830 | 2.992 | | | 86 | | | 3.164 | 3.334 | |
| 37 | | | 2.840 | 3.004 | | | 87 | | | 3.168 | 3.338 | |
| 38 | | | 2.850 | 3.016 | | | 88 | | | 3.172 | 3.342 | |
| 39 | | | 2.860 | 3.028 | | | 89 | | | 3.176 | 3.346 | |
| 40 | | | 2.870 | 3.040 | | | 90 | | | 3.180 | 3.350 | |
| 41 | | | 2.880 | 3.050 | | | 91 | | | 3.183 | 3.353 | |
| 42 | | | 2.890 | 3.060 | | | 92 | | | 3.186 | 3.356 | |
| 43 | | | 2.900 | 3.070 | | | 93 | | | 3.189 | 3.359 | |
| 44 | | | 2.910 | 3.080 | | | 94 | | | 3.192 | 3.362 | |
| 45 | | | 2.920 | 3.090 | | | 95 | | | 3.195 | 3.365 | |
| 46 | | | 2.928 | 3.098 | | | 96 | | | 3.198 | 3.368 | |
| 47 | | | 2.936 | 3.106 | | | 97 | | | 3.201 | 3.371 | |
| 48 | | | 2.944 | 3.114 | | | 98 | | | 3.204 | 3.374 | |
| 49 | | | 2.952 | 3.122 | | | 99 | | | 3.207 | 3.377 | |
| 51 | | | 2.967 | 3.137 | | | 100 | | | 3.210 | 3.380 | |
| 52 | | | 2.974 | 3.144 | | | | | | | | |

FIG. 5B

SKILL NORMALIZED HYBRID GAME

CROSS REFERENCE TO RELATED APPLICATIONS

This application is a continuation of Patent Cooperation Treaty Application No. PCT/US12/60600, filed on Oct. 17, 2012, and claims the benefit of U.S. Provisional Application Nos. 61/627,737, filed Oct. 17, 2011 and 61/630,204, filed Dec. 6, 2011, and is related to Patent Cooperation Treaty Application No. PCT/US11/26768, filed Mar. 1, 2011, Patent Cooperation Treaty Application No. PCT/US11/63587, filed on Dec. 6, 2011, and Patent Cooperation Treaty Application No. PCT/US12/58156, filed on Sep. 29, 2012, the contents of each of which are hereby incorporated by reference in its entirety as if stated in full herein.

FIELD OF THE INVENTION

Embodiments of the present invention are generally related to gaming and more specifically to a skill normalized entertainment game played among players with various skill levels in a skill normalized hybrid game that includes both a gambling game and an entertainment game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems and methods in accordance with embodiments of the invention operate a skill normalized hybrid game. One embodiment includes a skill normalized hybrid game, including: a gambling game including a real world engine constructed to provide a randomly generated payout for the gambling game; an entertainment software engine constructed to execute an entertainment game providing outcomes upon a player's skillful execution of the entertainment game, and manage a user interface of the entertainment game; a game world engine constructed to manage the entertainment software engine and communicate gameplay gambling event occurrences based upon a player's skillful execution of the entertainment game that trigger the randomly generated payout for the gambling game to the gambling game; and a skill normalization module constructed to: receive player performance measurements for at least one player from the game world engine; assign a handicap to the at least one player based at least in part upon the performance measurements for the at least one player from the game world engine; and send information concerning handicaps to the game world engine that configures the game world engine to implement each assigned handicap within the skill normalized hybrid game.

In a further embodiment, the skill normalization module is further constructed to assign a handicap to the at least one player based at least in part upon the performance measurements for at least one player from the game world engine by:

assigning a ranking to the at least one player based at least in part upon the received player performance measurements; and assigning a handicap to the at least one player based upon the ranking of the player to which the handicap is assigned.

In another embodiment, the player performance measurements include a first player's results against an opponent player; and the ranking is assigned to the first player based upon the opponent player's rank and the first player's results against the opponent player.

In a still further embodiment, the player performance measurements include information on experience points earned based upon game attributes; and the ranking is assigned to a player based upon the information on experience points earned by the player and an expected ranking based upon previously earned experience points by the player.

In still another embodiment, the skill normalization module is constructed to determine that a player's performance measurements are a significant deviation from expected player performance measurements.

In a yet further embodiment, the determining that a player's performance measurements are a significant deviation from expected player performance measurements utilizes an outlier test.

In yet another embodiment, the outlier test is the Grubb's outlier test.

In a further embodiment again, the outlier test is the Dixon Q-test.

In another embodiment again, the skill normalization module is constructed to adjust a player's handicap upon determining that a player's performance measurements are a significant deviation from expected player performance measurements.

In a further additional embodiment, the expected player performance is based upon historical player performance measurements.

Another additional embodiment includes a method of operating a skill normalized hybrid game that includes an entertainment game constructed to provide outcomes upon a player's skillful execution of the entertainment game, the method including: receiving player performance measurements for at least one player from a game world engine using a skill normalization module, where the game world engine is constructed to communicate gameplay gambling event occurrences based upon a player's skillful execution of the entertainment game that trigger the randomly generated payout for the gambling game to a gambling game including a real world engine constructed to provide a randomly generated payout for the gambling game; assigning a handicap to the at least one player based at least in part upon the performance measurements for the at least one player from the game world engine using the skill normalization module; and sending information concerning handicaps to the game world engine using the skill normalization module that configures the game world engine to implement each assigned handicap within the skill normalized hybrid game using the skill normalization module.

In a still yet further embodiment, the assigning a handicap to the at least one player based at least in part upon the performance measurements for the at least one player from the game world engine includes: assigning a ranking to each player based upon the received player performance measurements using the skill normalization module; and assigning a handicap to each player based upon the ranking of the player to which the handicap is assigned using the skill normalization module.

In still yet another embodiment, the player performance measurements include a first player's results against an opponent player; and the ranking is assigned to the first player based upon the opponent player's rank and the first player's results against the opponent player.

In a still further embodiment again, the player performance measurements include information on experience points earned based upon game attributes; and the ranking is assigned to a player based upon the information on experience points earned by the player and an expected ranking based upon previously earned experience points by the player.

In still another embodiment again, the skill normalization module is constructed to determine that a player's performance measurements are a significant deviation from expected player performance measurements.

In a still further additional embodiment, the determining that a player's performance measurements are a significant deviation from expected player performance measurements utilizes an outlier test.

In still another additional embodiment, the outlier test is the Grubb's outlier test.

In a yet further embodiment again, the outlier test is the Dixon Q-test.

In yet another embodiment again, the skill normalization module is constructed to adjust a player's handicap upon determining that a player's performance measurements are a significant deviation from expected player performance measurements.

A yet further additional embodiment includes a machine readable medium containing processor instructions, where execution of the instructions by a processor causes the processor to perform a process including: receiving player performance measurements for at least one player from a game world engine that is constructed to communicate gameplay gambling event occurrences based upon a player's skillful execution of an entertainment game that trigger a randomly generated payout for a gambling game to a gambling game; assigning a handicap to the at least one player based at least in part upon the performance measurements for the at least one player from the game world engine; and sending information concerning handicaps the game world engine that configures the game world engine to implement each assigned handicap within the skill normalized hybrid game.

BRIEF DESCRIPTION OF THE DRAWINGS

FIG. 5B is a lookup table that can be used to determine the probability that rejection of a player's performance at a skill normalized hybrid game as being inconsistent with the player's actual ability would be improper in accordance with an embodiment of the invention.

DETAILED DESCRIPTION

Figure 1A:
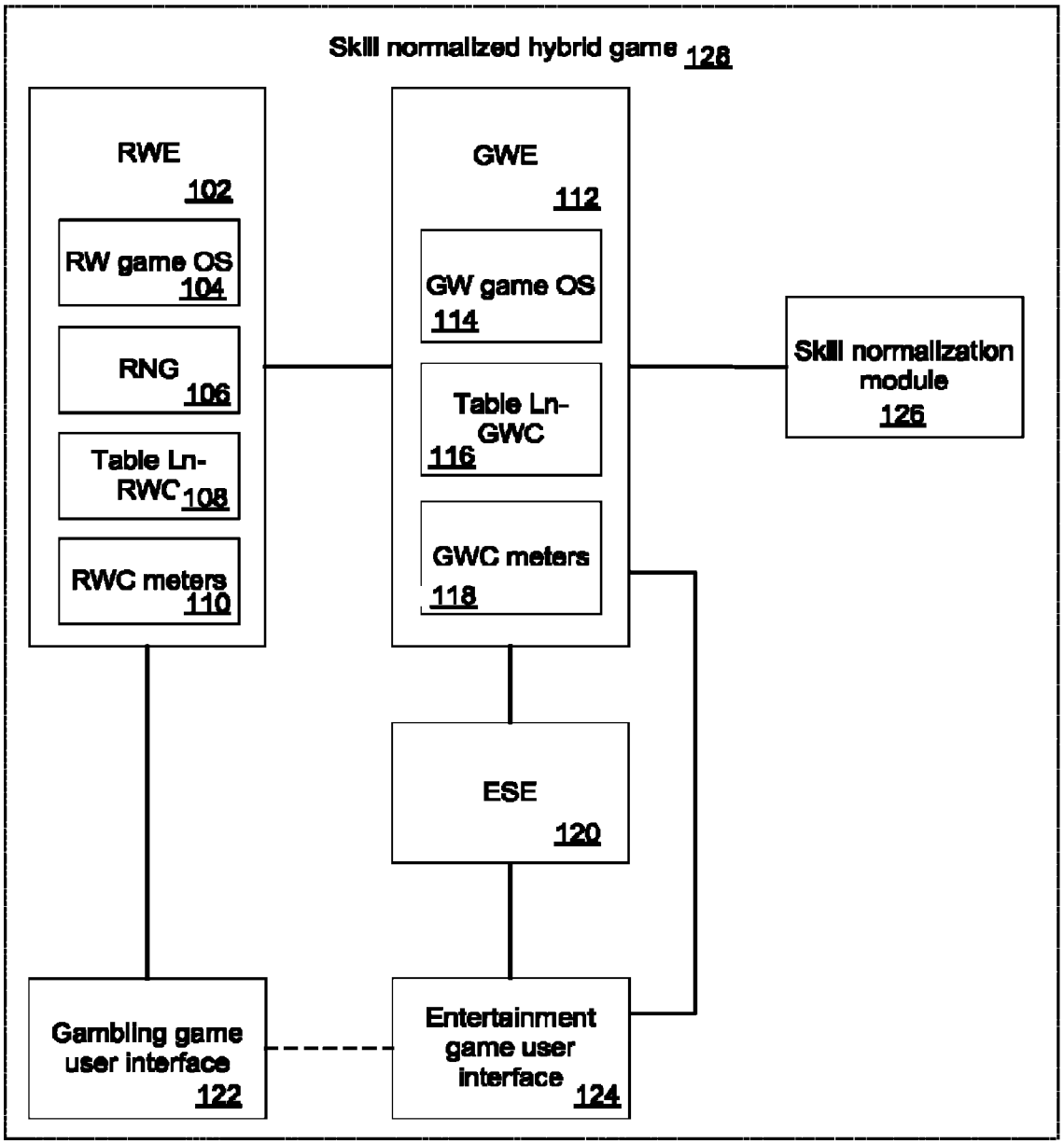
FIG. 1A illustrates a skill normalized hybrid game in accordance with an embodiment of the invention.

Turning now to the drawings, systems and methods for operation of a skill normalized hybrid game are illustrated. In several embodiments, a normalized hybrid game is a form of a hybrid game that integrates both a gambling game that includes a real world engine (RWE) which manages the gambling game, as well as an entertainment game that includes a game world engine (GWE) which manages the entertainment portion of a game, and an entertainment software engine (ESE) which executes the game for user entertainment. In certain embodiments, the skill normalized hybrid game also includes a user interface associated with either or both the gambling game and the entertainment game.

In operation of a skill normalized hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of game world objects, experience points, points, etc. Wagers are made in the gambling game using real world credits (RC or RWC). The real world credits can be credits in an actual currency, or may be credits in a virtual currency. Gambling outcomes from the gambling game may cause consumption, loss or accrual of real or virtual credits. In addition, gambling outcomes in the gambling game may influence elements in the entertainment game such as by restoring a consumed element, causing the loss of an element, restoration or placement of a fixed element, etc. Example elements include enabling elements (EE) which are elements that enable a player's play of the entertainment game and may be consumed during play and may also be replenished during play within the entertainment game. Other types of elements include actionable elements (AE) which are elements that are acted upon and may not be restorable during normal play of the entertainment game.

Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

In many embodiments, a skill normalized hybrid game utilizes a skill normalization module so that entertainment game play of the skill normalized hybrid game is fair to the player(s) of the skill normalized hybrid game irrespective of player skill level at the entertainment game. The skill normalization module can employ handicaps to entertainment game play to ensure that both less and more skilled players can derive a normal level of pleasure and progress in entertainment game play and that there is a fair amount of competition between players of different skill levels in head to head play of the entertainment game. In certain embodiments the skill normalization module only monitors entertainment game play to ensure fair game play of the skill normalized hybrid game irrespective of player skill level at the entertainment game. In particular embodiments the skill normalization module monitors the entire skill normalized hybrid game, such as by factoring in random outcomes in the entertainment game due to payouts from the gambling game, to ensure fair play of the entertainment game irrespective of player skill level at the skill normalized hybrid game.

In several embodiments, a skill normalization module ensures fair game play irrespective of player skill level by assigning rankings to each player of the skill normalized hybrid game based upon player performance measurements and by assigning handicaps based upon each player's rankings. In certain embodiments, player performance measurements are based upon a player's performance results from head to head play against opponents. In particular embodiments, player performance measurements are experience points for game attributes from which a player's ranking can be derived.

In numerous embodiments, a skill normalization module monitors a player's performance during entertainment game play after an initial player ranking is assigned to handicap the player if the player has significantly deviated from the player's expected performance at the entertainment game. In certain embodiments, statistical analysis using a player's current performance measurements and historical performance measurements are used determine if the player has significantly deviated from expected performance at the entertainment game. Skill normalized hybrid games in accordance with embodiments of the invention are discussed further below.

Skill Normalized Hybrid Games

In many embodiments, a skill normalized hybrid game integrates high levels of entertainment content with a game of skill (entertainment game), a gambling experience with a game of chance (gambling game), and a fair game play experience irrespective of player skill level with a skill normalization module. A skill normalized hybrid game provides for a random outcome independent of player skill while providing that the user's gaming experience (as measured by obstacles/challenges encountered, time of play and other factors) is shaped by the player's skill. A skill normalized hybrid game in accordance with an embodiment of the invention is illustrated in FIG. 1A. The skill normalized hybrid game 128 includes a RWE 102, GWE 112, ESE 120, gambling game user interface 122, entertainment game user interface 124 and a skill normalization module 126. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124. The skill normalization module 126 is connected with the GWE 112.

In several embodiments, the RWE 102 is the fundamental operating system for the gambling game of the skill normalized hybrid game 128 and controls and operates the gambling game. The operation of a gambling game is enabled by money, such as real funds, accretes and declinates real gambling credits based on random gambling outcome, and whose gambling proposition is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithm and/or processes, which are used to generate random outcomes. A level "n" real-world credit pay table (Table Ln-RWC) 108 is a table that can be used in conjunction with a random number generator (RNG) 106 to dictate the real world credits (RWC) earned as a function of game play and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game "level n" need not be the same for each level.

In many embodiments, the GWE 112 manages the overall skill normalized hybrid game operation, with the RWE 102 and the ESE 120 effectively being support units to the GWE 112. In several embodiments, the GWE 112 contains mechanical, electronic and software system for an entertainment game. The GWE 112 includes game. The GWE additionally contains a level "n" game world credit pay table (Table a GW game operating system (OS) 114 that provides control of the entertainment Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level "n" game world credit pay table (Table Ln-GWC) 116 dictates the GWC earned as a function of player skill in the nth level of the game. The payouts governed by this table are dependent upon player skill and game play at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of game play to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1A, the GWE 112 is also shown as connecting to the players user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implement using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a skill normalized hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independent from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's algorithm may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (i.e. power of the character, gun selection, car choice, etc.). In this manner, the player is always in control of the per game wager amount, with the choice mapping to some parameter or component that is applicable to the entertainment game experience of the hybrid game. In a particular embodiment, the RWE 102 operation can be a game of chance running every 10 seconds where the amount wagered is communicated from the GWE 112 as a function of choices the player makes in the operation profile in the entertainment game such as those cited above.

In many embodiments, a skill normalized hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance, such as a slot machine, is preserved. At the same time a rich environment of rewards to stimulate "garners" can be established with the entertainment game. In several embodiments, the skill normalized hybrid game can leverage very popular titles with "garners" and provides a sea change environment for casinos to attract players with games that are more akin to the type of entertainment which a younger generation desires. In various embodiments, players can use their skill towards building and banking GWC which in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, skill normalized hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The skill normalized hybrid game can include an entertainment game that includes head-to-head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to solitaire and babette).

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head to head competition in the context of their skill level in the entertainment game in question. As such, players can have a handicap associated with their player profile that describes their skill (which can be their "professed skill" in certain embodiments), and which is used by a GWE (such as a local GWE or a GWE that receives services from remote servers) to offer appropriate bets around the final and/or intermediate outcomes of the entertainment game, and/or to condition game play as a function of player skill, and/or to select players across one or more skill normalized hybrid games to participate in head to head games and/or tournaments.

Many embodiments enable the maximization of the number of players able to compete competitively by utilizing a skill normalization module. Handicapping enables players of varying performance potential to compete competitively regardless of absolute skill level, such as but not limited to where a player whose skill level identifies the player as a beginner can compete in head to head or tournament play against a highly skilled player with meaningful results.

In several embodiments, wagers can be made among numerous skill normalized hybrid games with a global betting manager (GBM). The GBM is a system that coordinates wagers that are made across multiple skill normalized hybrid games by multiple players. In some implementations it can also support wagers by third parties relative to the in game performance of other players. The GBM can stand alone, or is capable of being embedded in one of a number of systems, including a local ESE or any remote server capable of providing services to a skill normalized hybrid game, or can operate independently on one or a number of servers on-site at a casino, as part of a larger network and/or the internet or "cloud" in general. The GBM also supports the management of lottery tickets issued as a function of game play.

In numerous embodiments, the skill normalized hybrid game provides measures to provide handicapping in the context of entertainment games where the outcome of the entertainment game is in part or in whole determined by player skill and where wagers as a function of skill related performance and/or outcomes is permitted.

Although various components of skill normalized hybrid games are discussed above, skill normalized hybrid games can be configured with any component appropriate to the requirements of a specific application in accordance with embodiments of the invention. Network connected skill normalized hybrid games are discussed further below.

Network Connected Skill Normalized Hybrid Games

Figure 1B:
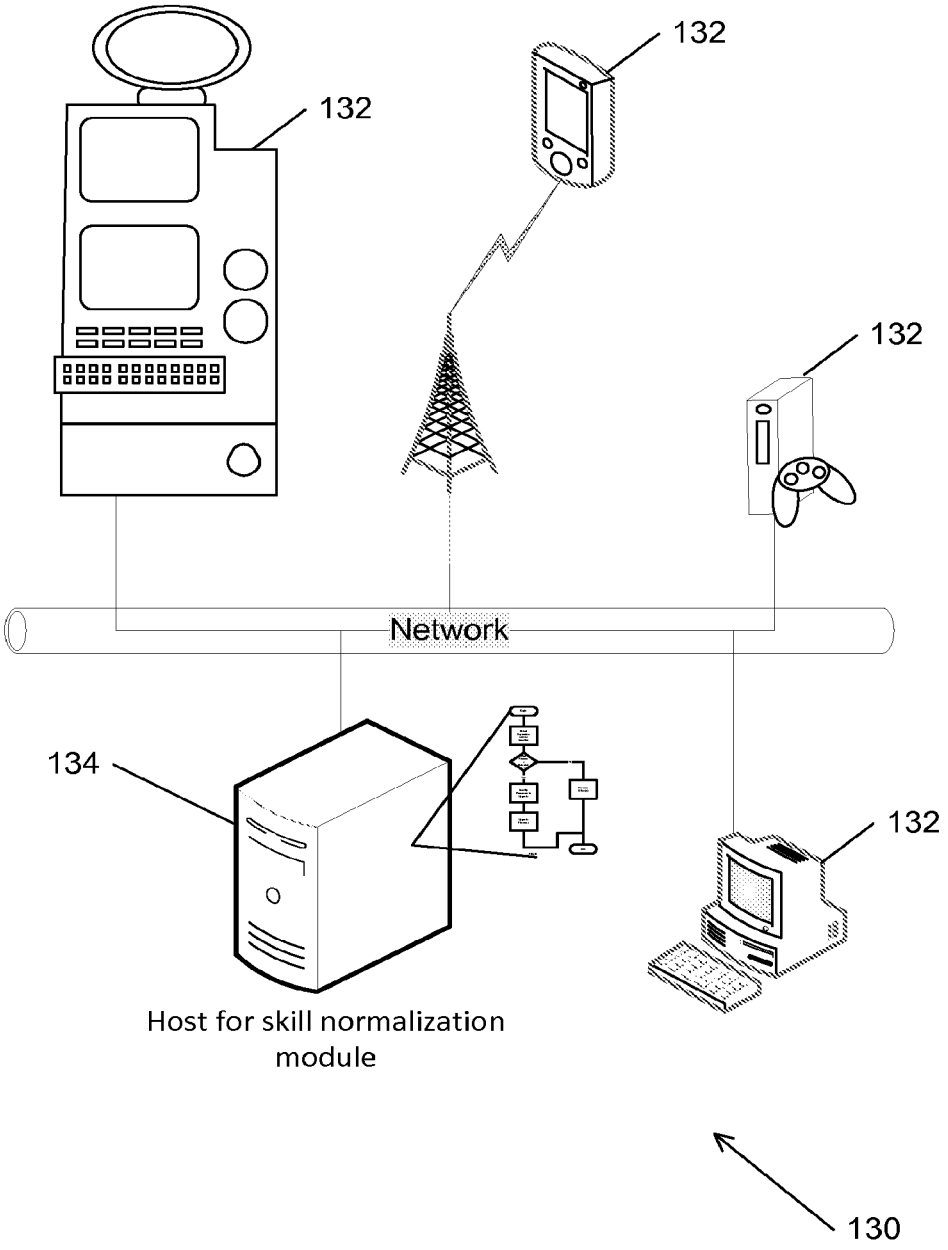
FIG. 1B is a deployment diagram illustrating a skill normalized hybrid game in accordance with an embodiment of the invention.
Figure 1C:
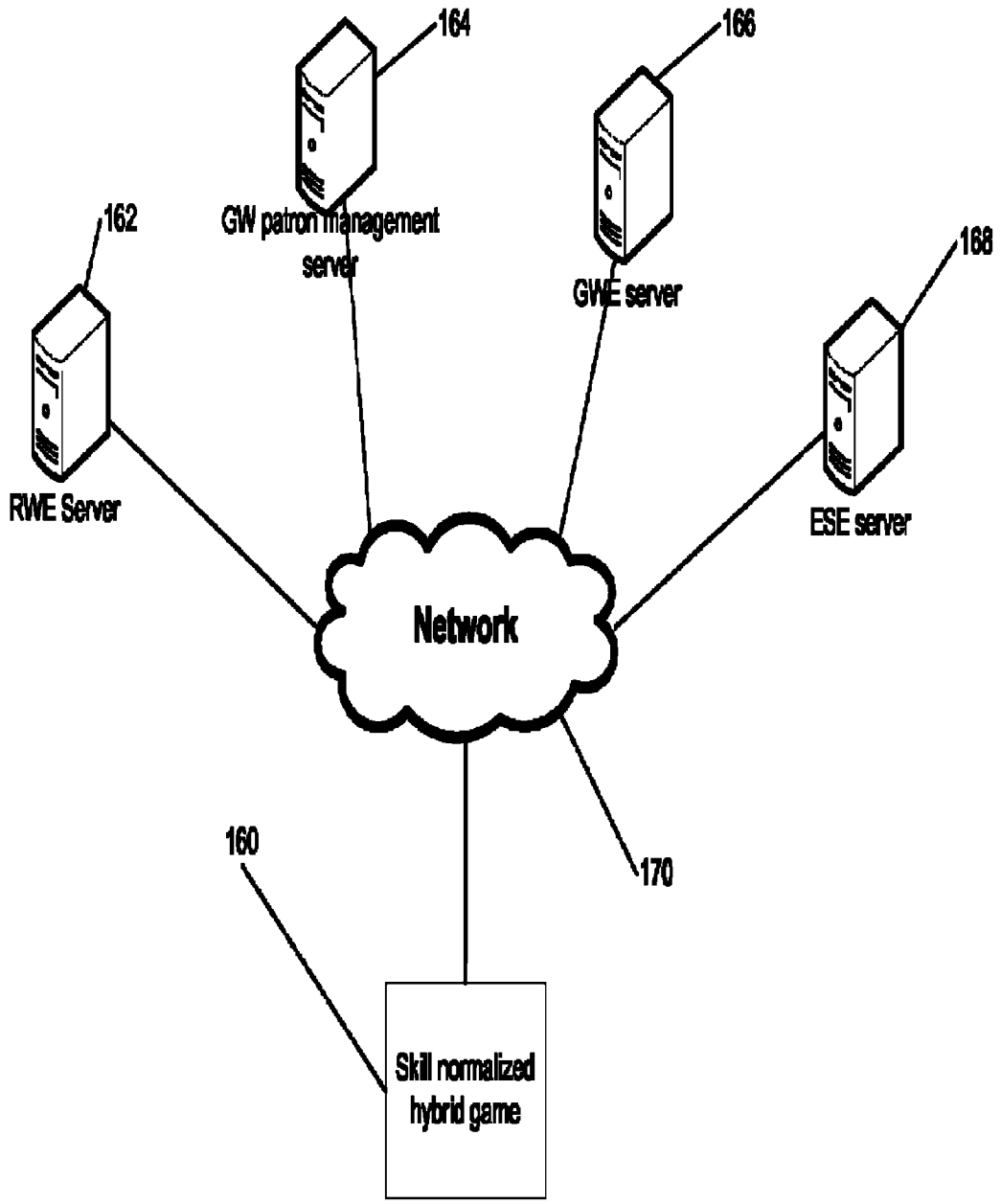
FIG. 1C is a system diagram that illustrates a network distributed skill normalized hybrid game in accordance with an embodiment of the invention.

Skill normalized hybrid games in accordance with many embodiments of the invention can operate locally while being network connected to draw services from remote locations or to communicate with other skill normalized hybrid games. In numerous embodiments, a skill normalization module receives player performance measurements from one or more skill normalized hybrid games and determines an appropriate skill level or ranking for the player based on those player performance metrics. Performance measurement data may include, but is not limited to, an outcome of the player playing the entertainment game, such as an expenditure, gain, loss or accumulation of GWC, player's experience points or the like (either as a rate or a total accumulation), a player's use of entertainment game resources such as EEs or AEs (either as a rate or an absolute amount) during one or more playing sessions, or a player's use, loss or accumulation of wagered credit resources, either real or virtual, (either as a rate or an absolute amount), etc. In addition, various other metrics may be derived from the performance measurement data, such as by determining a relationship, such as a ratio, between an outcome of the player's play of the entertainment game and a resource utilized by a player when playing the entertainment game. For example, determining the relationship of a rate of accumulation of GWC or other types of experience points by a rate of use of EE, credit, AE, etc. Other derivations may be determining a relationship between an accumulation of a GWC or other measure of experience by a total amount of a resource used, such as EEs, AEs, credits, etc. In a case where two or more players wish to compete against each other in a head to head skill normalized hybrid game, the skill normalization module determines an appropriate handicap for each player based on a comparison of the player's rankings. A deployment diagram of a skill normalized hybrid game in accordance with an embodiment of the invention is illustrated in FIG. 1B. In the diagram, a skill normalized hybrid game 130 may be hosted by any computing device 132 capable of presenting interactive entertainment and gambling games to a player, such as (but not limited to) a land based or casino gaming machine, a personal computer, a gaming console, a wireless device such as a personal digital assistant, notepad computer, or smart phone. The skill normalized hybrid games 130 may include a server 134 hosting a skill normalization module connected with the various computing devices via a computer network, such as a local area network or a wide area network.

In many embodiments, operations associated with a skill normalized hybrid game such as (but not limited to) processes for calculating score or RWC and GWC tracking can be performed across multiple devices. These multiple devices can be implemented using or in connection with a single server or a plurality of servers such that a skill normalized hybrid game is executed as a system in a virtualized space, such as (but not limited to) where the RWE and GWE are large scale centralized servers "in the cloud" coupled to a plurality of widely distributed ESE controllers or clients via the Internet.

In many embodiments, an RWE server can perform certain functionalities of a RWE of a skill normalized hybrid game. In certain embodiments, a RWE server includes a centralized odds engine which can generate random outcomes (such as but not limited to win/loss outcomes) for a gambling game, thereby eliminating the need to have that functionality of the RWE performed locally within the skill normalized hybrid game. The RWE server can perform a number of simultaneous or pseudo-simultaneous runs in order to generate random outcomes for a variety of odds percentages that one or more networked skill normalized hybrid games may require. In certain embodiments, an RWE of a skill normalized hybrid game can send information to a RWE server including (but not limited to) Table Ln-RWC tables, maximum speed of play for a gambling game, gambling game monetary denominations or any promotional RWC provided by the operator of the skill normalized hybrid game. In particular embodiments, a RWE server can send information to a RWE of a skill normalized hybrid game including (but not limited to) RWC used in the gambling game, player account information or play activity and a profile associated with a player.

In several embodiments, a GWE server can perform the functionality of the GWE across various skill normalized hybrid games. These functionalities can include (but are not limited to) providing a method for monitoring high scores on select groups of games, linking groups of games in order to join them in head to head tournaments, and acting as a tournament manager.

In a variety of embodiments, management of player account information can be performed by a GWE patron management server separate from a GWE server. A GWE patron management server can manage player account information, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of a skill normalized hybrid game can send information to a GW patron management server including (but not limited to) GWC and RWC used in a game, player account information, play activity and profile information for players and synchronization information between a gambling game and an entertainment game or other aspects of a skill normalized hybrid game. In particular embodiments, a GW patron management server can send information to a GWE of a skill normalized hybrid game including (but not limited to) entertainment game title and type, tournament information, Table Ln-GWC tables, special offers, character or profile setup and synchronization information between a gambling game and an entertainment game or other aspects of a skill normalized hybrid game.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

Servers connected via a network to implement skill normalized hybrid games in accordance with many embodiments of the invention can communicate with each other to provide services utilized within a skill normalized hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the skill normalized hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a skill normalized hybrid game tournament. Typically a GWE (such as a GWE that runs within a skill normalized hybrid game or on a GWE server) is not aware of the relationship of itself to the rest of a tournament since in a typical configuration the actual tournament play is managed by the ESE server. Therefore, management of a skill normalized hybrid game tournament can include (but is not limited to) tasks such as: conducting tournaments according to system programming that can be coordinated by an operator of the skill normalized hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a skill normalized hybrid game, exchange of data necessary to link a player's profile to their ability to participate in various forms of game play (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular skill normalized hybrid game, as recorded in their player account, determining a player's play and gambling performance for the purposes of marketing intelligence, and logging secondary drawing awards, tournament prizes, RWC and GWC into the player's account.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with a skill normalized hybrid game locally. In certain embodiments, a server is a server system including a plurality of servers, where software may be run on one or more physical devices. Similarly, in particular embodiments, multiple servers may be combined on a single physical device.

Skill normalized hybrid games in accordance with many embodiments of the invention can be networked with remote servers in various configurations. A networked skill normalized hybrid game in accordance with an embodiment of the invention is illustrated in FIG. 10. The networked skill normalized hybrid game 160 is connected with a RWE server 162, GW patron management server 164, GWE server 166 and ESE server 168 over a network 170, such as (but not limited to) the Internet. Servers networked with a networked skill normalized hybrid game 160 can also communicate with each of the components of a networked skill normalized hybrid game and amongst the other servers in communication with the networked skill normalized hybrid game 160.

Although various networked skill normalized hybrid games are discussed above, networked skill normalized hybrid games can be configured in any manner as appropriate to the requirements of a specific application in accordance with embodiments of the invention. Assignment of handicaps within skill normalized hybrid games are discussed further below.

Handicap Assignments

Figure 2:
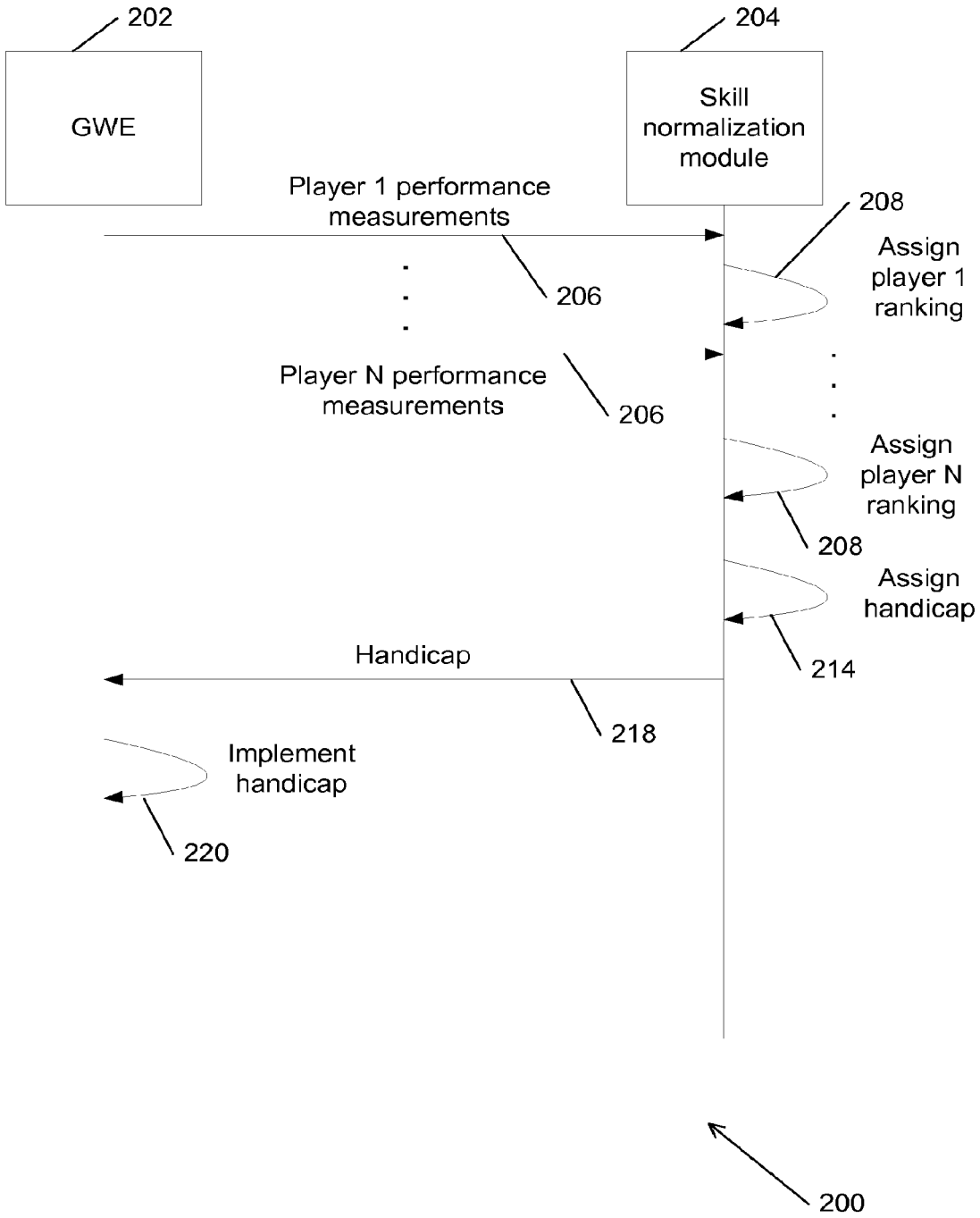
FIG. 2 is a sequence diagram illustrating the operation of a skill normalized hybrid game that implements handicaps based upon player ranking in accordance with an embodiment of the invention.

Skill normalized hybrid games in accordance with many embodiments of the invention can provide the fairness of entertainment game play irrespective of player skill level by assigning handicaps to players based upon a player's performance measurements. A skill normalized hybrid game includes a GWE that utilizes input from a skill normalization module to implement the proper handicap to players to ensure fairness of entertainment game play. A skill normalization module is able to assign handicaps based upon a player's ranking, and a player's ranking can be based upon performance measurements received from a GWE. A sequence diagram illustrating the operation of a skill normalized hybrid game that assigns handicaps according to player skill level in accordance with an embodiment of the invention is illustrated in FIG. 2. The sequence diagram 200 includes interactions between a GWE 202 of a skill normalized hybrid game and a skill normalization module 204. The sequence includes a skill normalization module receiving (206) player performance measurements for each player and assigning (208) a ranking for each player based upon how each player's performance measurements are related to the performance measurements of other players. Once all players have been ranked, appropriate handicaps are assigned (214) for each of the players based upon the rank of each player. The skill normalization module then returns (218) instructions to apply appropriate handicaps for each player to the GWE and the GWE implements (220) the handicap.

Although various skill normalized hybrid games constructed to assign handicaps to players are discussed above, skill normalized hybrid games can be constructed to assign handicaps in any manner as appropriate to the requirements of a specific application in accordance with embodiments of the invention. Assignment of rank in skill normalized hybrid games are discussed further below.

Rank Assignments

Performance in the context of the entertainment game in accordance with many embodiments of the invention is a function of both player skill and a certain degree of randomness introduced during entertainment game play. In order to apply the correct handicap, a player's skill level is ranked. As a player's skill level increases or decreases, the player's overall rank, and therefore handicap, can be adjusted to reflect the change in player skill level. Additionally, a player's skill level at a particular entertainment game may not be related to the player's skill level at other entertainment games. For example, success in a racing type entertainment game may not be indicative of the player's skill level in a shooting type entertainment game. However, a player's skill level in one game may be related to a player's skill level in a related game, such as sequels to the same entertainment game.

In many embodiments, a player may be ranked depending on the ratings of the player's opponents, and the results of the player's play against the opponents. In certain embodiments, the relative difference in rating between two players determines an estimate for the expected score between them. The design of the ranking system, including the range and mean rank may be chosen by the operator as appropriate for the skill normalized hybrid game. Thereby, rankings are calculated based on the strength of a player's opponent and the actual results of the game play between the players. This system, where performance is not measured absolutely, allows handicapping inferred from wins, losses, and draws against other players. If a player wins a game, the player is assumed to perform at a higher level than his opponent for that game. Conversely if a player loses, the player is assumed to perform at a lower level than the opponent. If the game is a draw, the two players are assumed to perform at nearly the same skill level.

In several embodiments, these rankings are then used to predict performance so handicapping can be applied. When a player's results exceed the player's expected scores, the system takes this as evidence that a player's ranking is too low, and can be adjusted upward. Similarly when a player's actual results fall short of the player's expected scores, that player's ranking can be adjusted downward. The skill normalization module may use a simple linear adjustment proportional to the amount by which a player over performed or underperformed the expected score. This type of system can be used in a variety of entertainment games. Additionally, this rating can be applied when a player's performance is measured over time, rather than during play of single gaming session. The adjustment mechanism may also include a "deadband" or weighting functionality such that the player's rating is not immediately adjusted solely as a function of a single or recent performance(s), but rather considers recent results in the context of a broader set of player performance data.

In numerous embodiments, different rankings can be divided into "bands of skill," (similar but not the same as the popular chess ranking system Elo, where a player with an Elorating from 2000-2199 may be considered an expert, while a rating from 600-799 may be considered a beginner). This allows a general handicap to be assigned to different skill bands rather than to individual ranks depending on the entertainment game in question.

In a variety of embodiments, players are placed on a "ladder" and each player is assigned a numerical value that shows how skilled the player is at a certain game. The ladder system proceeds via a system of challenges. Head to head games may occur on a scheduled or ad hoc basis between different rungs on the ladder. In ad hoc play, a first player may challenge a player at a higher level on the ladder. In certain embodiments, refusing a challenge may lead to penalties for the refusing player (such as but not limited to reduction in rank, and/or being barred from tournaments). If the low-ranked player wins the match, then the two players swap places on the ladder or are moved up and down a certain number of "rungs" on the ladder (which may also affect the position of other players between the two rungs initially occupied by the two players). If the low ranked player loses, then that player may be banned from challenging the same person again without challenging someone else first. There may be a limit as to how many rungs above themselves players may challenge. Initial placement on the ladder may be random or deterministic based upon an entry test/challenge.

In a number of embodiments, player ranking may be assigned on level based progression. A player can accumulate experience points (XP) based on play time, tasks undertaken, skills learned and/or a variety of other criterion. To "level" or "level up," a player gains enough XP to reach the next level. When a level is gained, the player's abilities or statistics increase, making the player stronger. In a number of embodiments, a player's ranking is based (at least in part) on the level attained by the player, and a handicap assigned accordingly.

In many embodiments, skill level may be assigned based on performance in specific aspects of the game. In certain embodiments involving a hunting game, factors including but not limited to accuracy, type of animals killed, and kill quantities may be valued separately and then combined to provide the overall ranking. In particular embodiments, skill level is not necessarily based on wins/loses, and handicapping may be applied based on specific aspects of the game (a skilled player in each aspect of the above hunting game may be handicapped with features such as, but not limited to, less accurate guns, fewer numbers of animals, or more difficult kill-shots).

In several embodiments, there can be a short period at the onset of game play during which the skill normalization module assesses player's current skill level and evaluates that skill level relative to the player's historical skill level(s) before applying the appropriate handicap. In a number of embodiments, the skill normalization module assesses player skill level throughout game play to evaluate the player's skill level. The skill normalization module may then apply the appropriate handicap at the conclusion of the game play session.

In various embodiments, a player can use a skill normalized hybrid game in a mode (such as for a short period of time and/or without payment) whereby the player is "tested" to establish a skill rating. This mode can be finite rather than at the beginning of gameplay. Also, this test mode can be distinct from actual gameplay.

In numerous embodiments, if no professed skill is on record, players may select the skill level they believe to be appropriate. This selection could be incorporated into player/account selection at the start of gameplay rather than as a separate event. As play continues, the player's performance is measured and compared to others of the professed skill level. Where there are discrepancies, the rating assigned and the handicap applied is adjusted. Alternatively, players that estimate their performance inaccurately may be disqualified from play.

In several embodiments, ranking systems can implement skill floors for individual players. A skill floor is the minimum ranking that a player can fall to. For instance, if a player has an established ranking of "expert", subsequent poor performances cannot reduce his ranking to "beginner." However, depending on the hybrid game in question, an "expert" player may have his or her rank decreased to an "intermediate player," depending on the skill floor assigned. A skill floor may be assigned according to any arbitrary criteria, including but not limited to the number of games played, amount of money won, amount of games won, and/or additional factors that can be used establish a player's skill level.

Several embodiments may or may not require participation in a player club. When a player club is unavailable or a player elects not to participate in one, the player is still identified. Rather than linked explicitly to a specific account, the player is anonymously tracked, via the use of a ticket, code, or other means by which a player is given a unique ID that persists but is not tied to a player's person (such as but not limited to not being linked specifically to the player's name).

In numerous embodiments, rankings may be continuous or discrete. Rankings may be specific to the casino, the casino family, and/or geographic location or other divisions. The skill normalization module may function to normalize disparate rankings or rankings across multiple systems and locations.

Figure 3A:
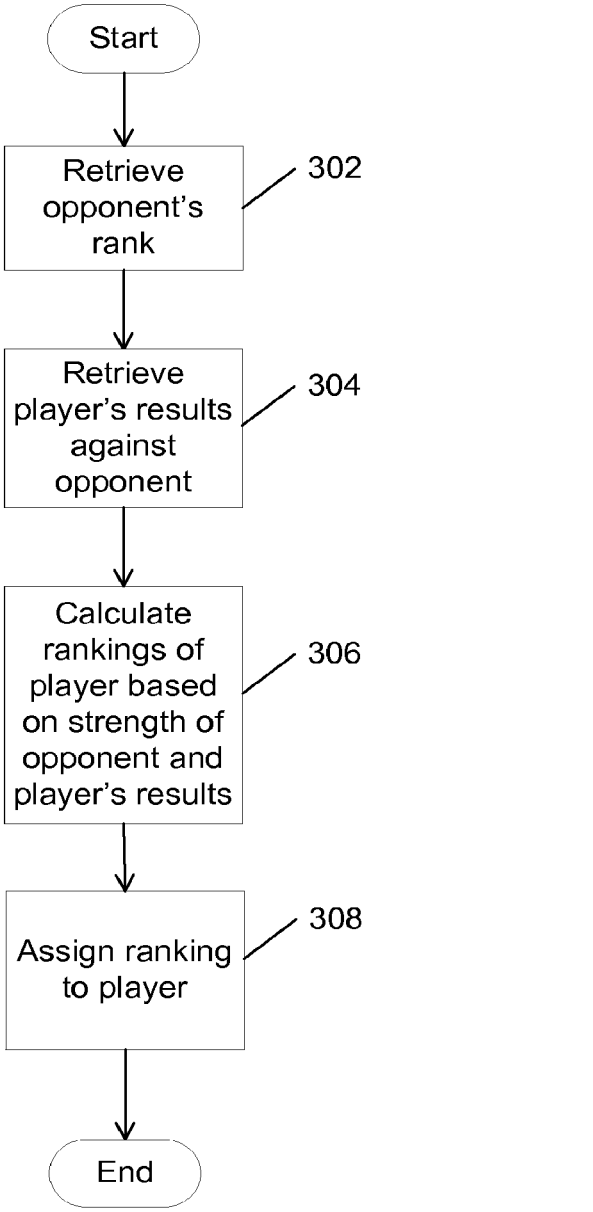
FIG. 3A is a flow chart of a process using player performance measurements during head to head play with other players with known rankings in accordance with an embodiment of the invention.

A flow chart of a process of using player performance measurements during head to head play with other player's whose rankings are known in accordance with an embodiment of the invention is illustrated in FIG. 3A. The process includes a skill normalization module retrieving (302) an opponent's rank from a GWE. The process also includes retrieving (304) the results of a player's performance against the opponent. These results can be stored in the GWE and retrieved after a game play session has ended or may be retrieved in real time as the players compete. The processes of a skill normalization module retrieving an opponent's rank (302) or a player's results against an opponent (304) can be performed in any order. Player rankings are calculated (306) based upon the opponent's rank and the results of the player's performance against the opponent. After player rankings are calculated (306), the rankings can be assigned (308) to the player.

Figure 3B:
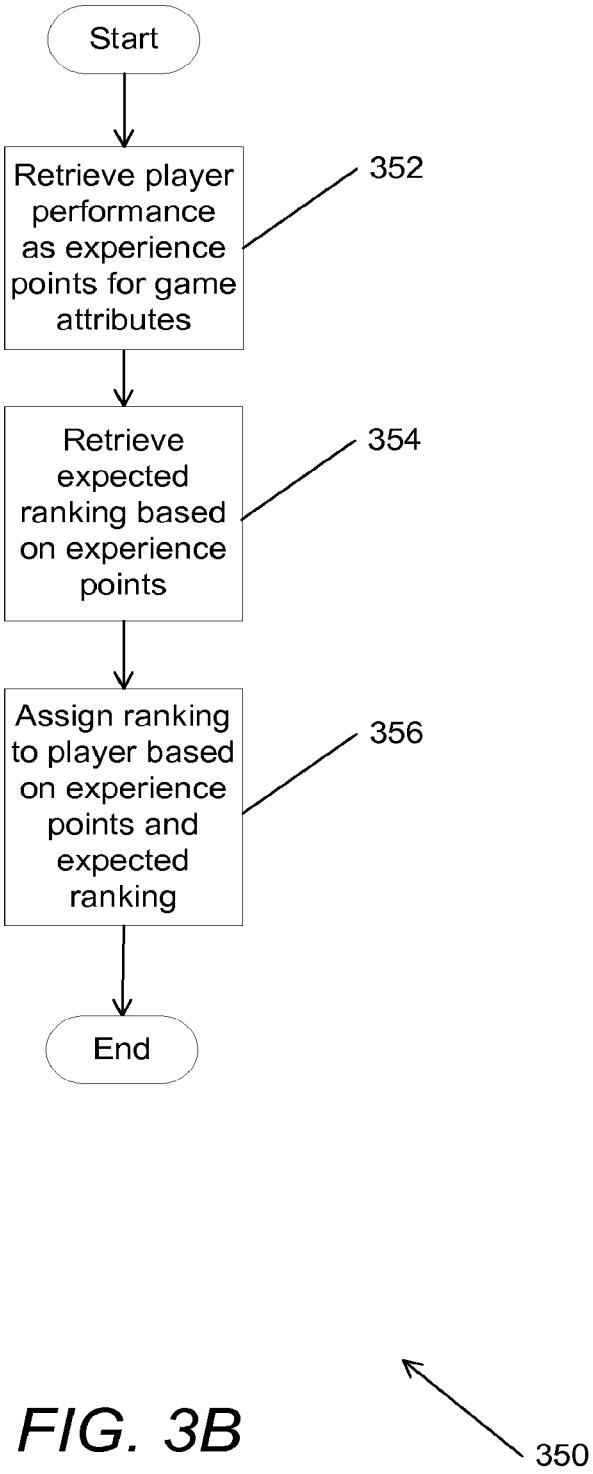
FIG. 3B is a flow chart of a process of using player performance measurements during head to head play with other players with known experience points in accordance with an embodiment of the invention.

A flow chart of a process to rank a player based on experience points accumulated in accordance with an embodiment of the invention is illustrated in FIG. 3B. This process 350 includes a skill normalization module retrieving (352) player performance from a GWE as experience points that the player earns while playing a skill normalized hybrid game with a set of game play attributes, such as but not limited to the difficulty of play or the level that the player is playing. Also, expected ranking based upon experience points earned by a player historically can also be retrieved (352) by the skill normalization module from a GWE. These expected rankings and current performance based upon experience points can be analyzed (356) by the skill normalization module to assign a ranking to the player.

Although various skill normalized hybrid games constructed to assign rank to players are discussed above, skill normalized hybrid games can be constructed to assign rank in any manner as appropriate to the requirements of a specific application in accordance with embodiments of the invention. Evaluation of rank in skill normalized hybrid games are discussed further below.

Rank Evaluations

A handicap may be assigned to a player in accordance with many embodiments of the invention after a player's rank is established. These assignments may vary based on a variety of factors including, but not limited to, the type of skill normalized hybrid game, the type of ranking, measurable GW elements, and operator preference.

In several embodiments, utilization of a skill normalization module can provide advantages to low skill player(s) in order to provide fair game play irrespective of player skill. These advantages may consist of (but are not limited to) access to better equipment, advantages in timing, extra moves, better starting position, relative scoring, or a variety of other mechanisms. For instance, a low skill player may pick up night vision goggles to provide higher visibility in a shooter game, or better armor in a sword fighting game. In a racing game, the low skill player may be granted a head start at the start of the race. In a turn based game, the low skill player may gain additional opportunities to attack an opponent. In a fighting game, the player may have increased health at the start of gameplay. In a foosball game, the player may get two points for each goal scored rather than a single point. These advantages may dynamically change as a result of gameplay.

In numerous embodiments, utilization of a skill normalization module can disadvantage more skilled player(s) in order to provide fair game play irrespective of player skill. These disadvantages can occur through (but are not limited to) introducing a random element or element(s) into the game, changing the player's options, relative scoring, or adjusting overall score at the end of gameplay. In a shooting game, for example, the accuracy with which shots can be aimed at targets can be a function of the aim of the player plus a random component that impacts the trajectory of the player's shot. For a more skilled player, the random component may be increased, decreasing the effect of the player's skill. In a racing game, the cars available to more skilled players may break down more readily. In a shooting game, the more skilled player may not be able to use certain guns or other weaponry. In a basketball shooting game, the player's baskets may be worth 1 point instead of two points.

In a number of embodiments, game play itself is not affected through the utilization of a skill normalization module, but the payouts available may vary. Asymmetrical bets could be structured in accord with the skill level of each player. In certain embodiments, if a low skill player is matched against a high skill player, the high skill player may enter into a bet with the low skill player that provides the low skill player with better odds. Therefore, the bet is structured in such a way that the potential winnings vary accordingly. For example, a high skilled player and a low skilled player may both be required to bet 10 credits. If the high skilled player wins, the high skilled player would receive 14 credits. If the low skilled player wins, the low skilled player receives 16 credits. The remaining balance may be taken by the operator as a rake. In another example, players may have to place asymmetrical stakes for gameplay. For example, in a chess game the high skill player may wager 100 credits, while the low skill player may wager 10 credits. The low skill could potentially win 100 credits (minus what the operator may claim as a rake), while the high skill player could win 10 (minus what the operator may claim as a rake).

Figure 4:
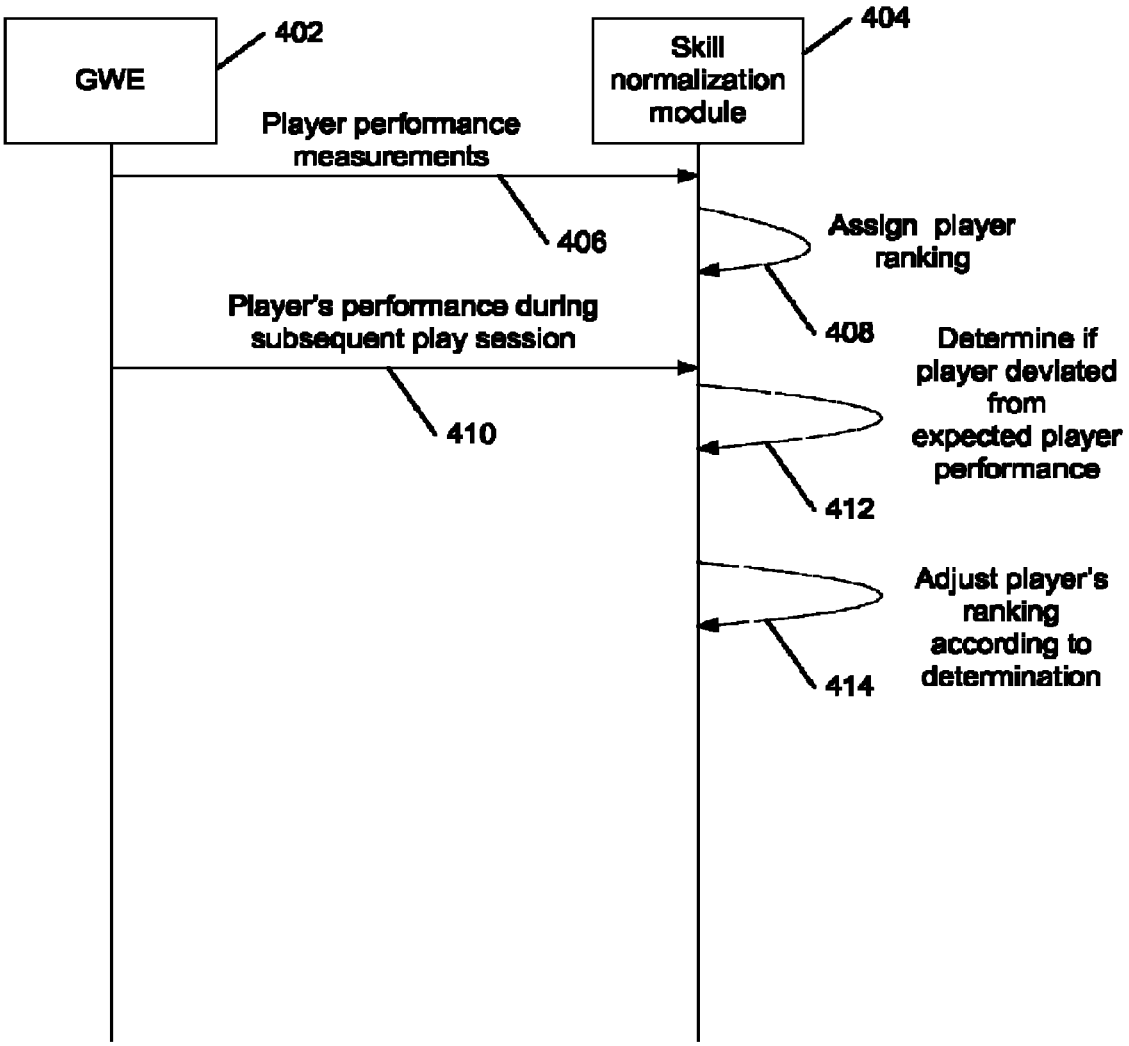
FIG. 4 is a sequence diagram illustrating the operation of a skill normalized hybrid game that adjusts a player's ranking according to a determination of whether the player significantly deviated from expected performance in accordance with an embodiment of the invention.

A sequence diagram illustrating the operation of a skill normalized hybrid game that adjusts a player's ranking dynamically in accordance with an embodiment of the invention is illustrated in FIG. 4. The skill normalization module 404 receives (406) player performance measurements from a GWE 402 and assigns (408) player rankings based upon the player performance measurements. Then, the skill normalization module 404 receives (410) player performance measurements from subsequent sessions of entertainment game play after the initial rankings were assigned. The skill normalization module 404 can analyze the subsequent performance measurements to determine (412) if the player significantly deviated from expected player performance and adjust (414) the player's rankings in light of the significant deviation.

Figure 5A:
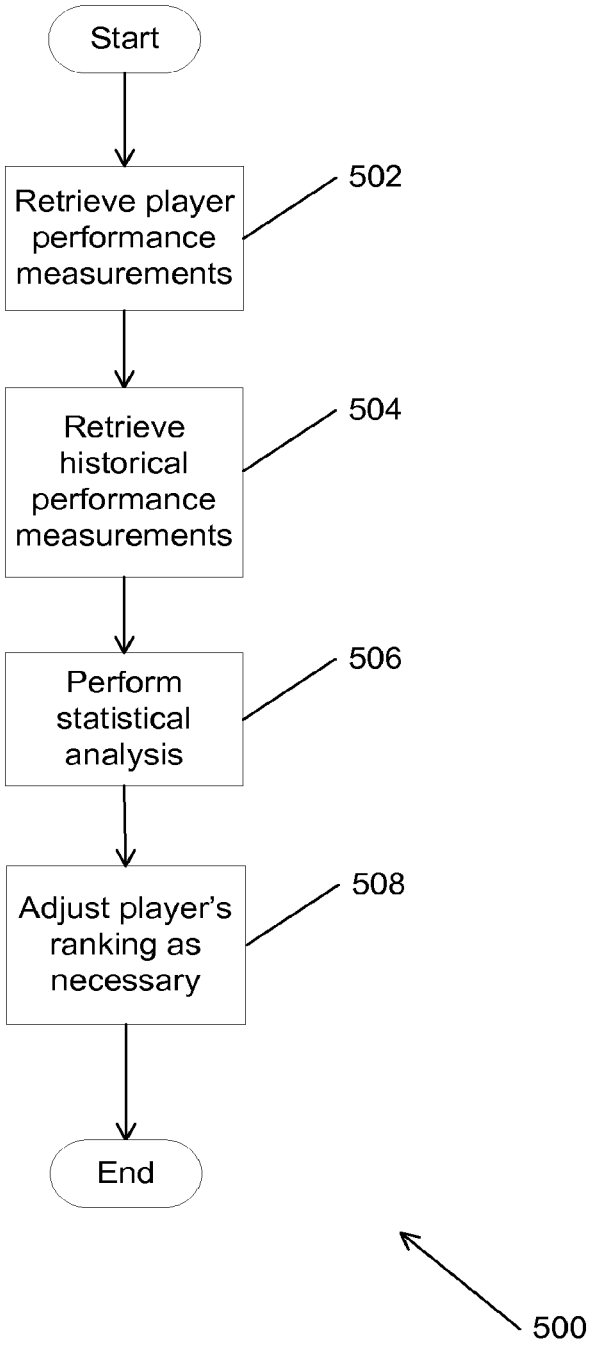
FIG. 5A is a flow chart of a process of using a skill normalization module to determine whether a player's current performance significantly deviated from historical performance in accordance with an embodiment of the invention.

A process flow diagram of a process for determining if a player's current performance at a skill normalized hybrid game exceeds historical performance in accordance with an embodiment of the invention is illustrated in FIG. 5A. The process 500 includes a skill normalization module retrieving current player performance measurements (502) and historical performance measurements (504) from a skill normalized hybrid game. Historical performance measurements can be the particular player's historical performance measurements or historical performance measurements from a group of players. The order in which current player performance measurements and historical performance measurements are retrieved is non-limiting and can be retrieved in any order. The skill normalization module then performs (506) statistical analysis upon the current player performance measurements and historical performance measurements. If there is sufficient deviation from expected performance measurements, then the player's rankings and corresponding handicaps can be adjusted (508) accordingly. In various embodiments, the player's ranking, and subsequent handicap may be re-ranked upward to a higher rank. However, if the currently player's performance measurement information indicates a poorer quality of fair play during the current play session, the player's rank, and subsequent handicap, may be adjusted to a lower value.

In many embodiments, an outlier test is used to determine if the player's current performance information indicates that the player has significantly deviated from expected performance. In certain embodiments, an outlier test such as (but not limited to) the Grubb's outlier test can be used. The Grubb's outlier test can be used to detect outliers in a data set assumed to come from a normally distributed population. To perform the Grubb test, a value T is calculated:

$$T=\mathrm{Abs}(Xi-X\mathrm{mean})/s$$

where:

Abs( )=absolute value function;

Xi=observed player performance measurements for a current play session;

Xmean=mean of historical player performance measurements for previous play sessions; and s=standard deviation of Xmean.

Once T is calculated, a lookup table is used to determine the probability that a rejection of Xi as belonging to the population of Xmean is improper. For example, the lookup table illustrated in FIG. 5B can be utilized. In FIG. 5B, the headings represent the probability, in percentages, that a rejection is improper, and N is the number of sampled historical data points for player performance that were used to calculate Xmean.

In other embodiments, any technique for determining whether player performance is inconsistent with past performance can be utilized as appropriate to the requirements of a specific skill normalized hybrid game.

The table is used by looking up the value of T in the table for the number N samples. Then, the probability is determined by looking up the column to the probability value featured in the header. For example, if N=20 sampled player performance measurements and T is calculated to be 2.71, then the rejection of Xi as not belonging to the population of the sampled player performance measurements has a 2.5% chance of being improper. Put another way, there is a 97.5% chance the particular instance of player performance is proper.

In several embodiments, outlier tests such as (but not limited to) Dixon's Q-test are used. In a Dixon Q-test, a ratio of distance between a tested value and its next closest value in a set of sampled values as compared to the range of all values in the sample is used to determine if the tested value comes from the same population as the set of sampled values. In certain embodiments, a process for determining a Q-test is as follows.

The sampled values of historical player performance measurements are arranged in ascending order:

$X_1<X_2<\ldots<X_N$

A ratio, $Q_{exp}$, is calculated as the difference between the value of the currently player performance measurement, $X_N$, being tested from its nearest neighbor value, $X_{N-1}$, divided by the range of the values of player performances:

$$Q_{exp}=\frac{X_2-X_1}{X_N-X_1}$$

-continued $$Q_{exp}=\frac{X_N-X_{N-1}}{X_N-X_1}$$

The obtained $Q_{exp}$ value is compared to a critical Q-value ($Q_{crit}$) found in the table containing the critical Q values produced below. If $Q_{exp}>Q_{crit}$ for a particular confidence interval, then the tested player performance value can be characterized as an outlier, that is, that the current player performance measurement may significantly deviate from expected player performance measurements in a statistically meaningful way.

A table containing the critical Q values for confidence level (CL) 90%, 95% and 99% and N=3-10 is given below:

Table of critical values of Q

| N | $Q_{crit}$ (CL: 90%) | $Q_{crit}$ (CL: 95%) | $Q_{crit}$ (CL: 99%) |
|---|---|---|---|
| 3 | 0.941 | 0.970 | 0.994 |
| 4 | 0.765 | 0.829 | 0.926 |
| 5 | 0.642 | 0.710 | 0.821 |
| 6 | 0.560 | 0.625 | 0.740 |
| 7 | 0.507 | 0.568 | 0.680 |
| 8 | 0.468 | 0.526 | 0.634 |
| 9 | 0.437 | 0.493 | 0.598 |
| 10 | 0.412 | 0.466 | 0.568 |

In certain embodiments, the expected performance can be the player's own historical performance while playing a particular hybrid game. In particular embodiments, the expected performance can be the performance of other players having the same or similar ranking as the player in question for a particular hybrid game.

Figure 6:
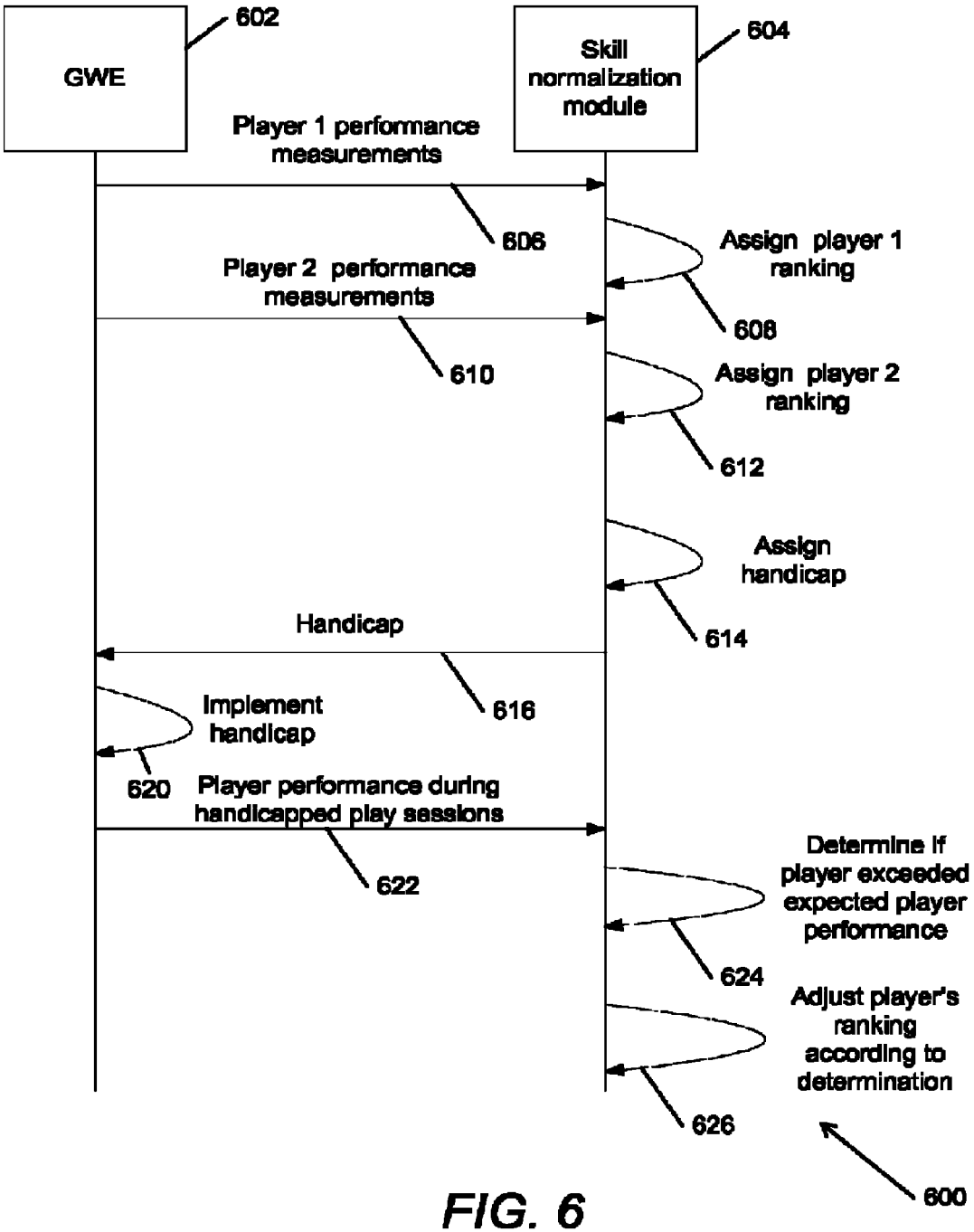
FIG. 6 is a sequence diagram illustrating the operation of a skill normalized hybrid game that adjusts a player's ranking according to a determination of whether a player significantly deviated from expected performance with a handicap in accordance with an embodiment of the invention.

A timing diagram describing a skill normalized hybrid game that assigns handicaps to players that can be dynamically adjusted by current play sessions in accordance with an embodiment of the invention is illustrated in FIG. 6. The timing diagram 600 includes a skill normalization module 604 receiving (606) player performance measurements from a GWE 602 for a first player and then assigning (608) a ranking to the first player. Next, the skill normalization module receives (610) player performance measurements from a second player and assigns (612) a ranking for the second player. Then handicaps are assigned (614) by the skill normalization module 604 based upon the rankings of the players and the handicaps are sent (616) to the GWE 602. The skill normalized hybrid game implements (620) the handicaps for each player. The skill normalization module also receives (622) information on player performance during the handicapped play sessions to determine (624) if the player significantly deviates from expected player performance in a statistically meaningful way. The information on player's performance can include current as well as historical player performance and can also include information on the particular player, other players or a group of players. If the player significantly deviates from the expected player performance in a statistically meaningful way, then the player's ranking, can be adjusted (626) accordingly. In certain embodiments, the player's handicap is also adjusted according to the adjustment made to the player's ranking.

Although various skill normalized hybrid games constructed to evaluate the rank of players are discussed above, skill normalized hybrid games can be constructed to evaluate rank in any manner as appropriate to the requirements of a specific application in accordance with embodiments of the invention. Processing apparatuses capable of implementing skill normalized hybrid games are discussed further below.

Processing Apparatus

Figure 7:
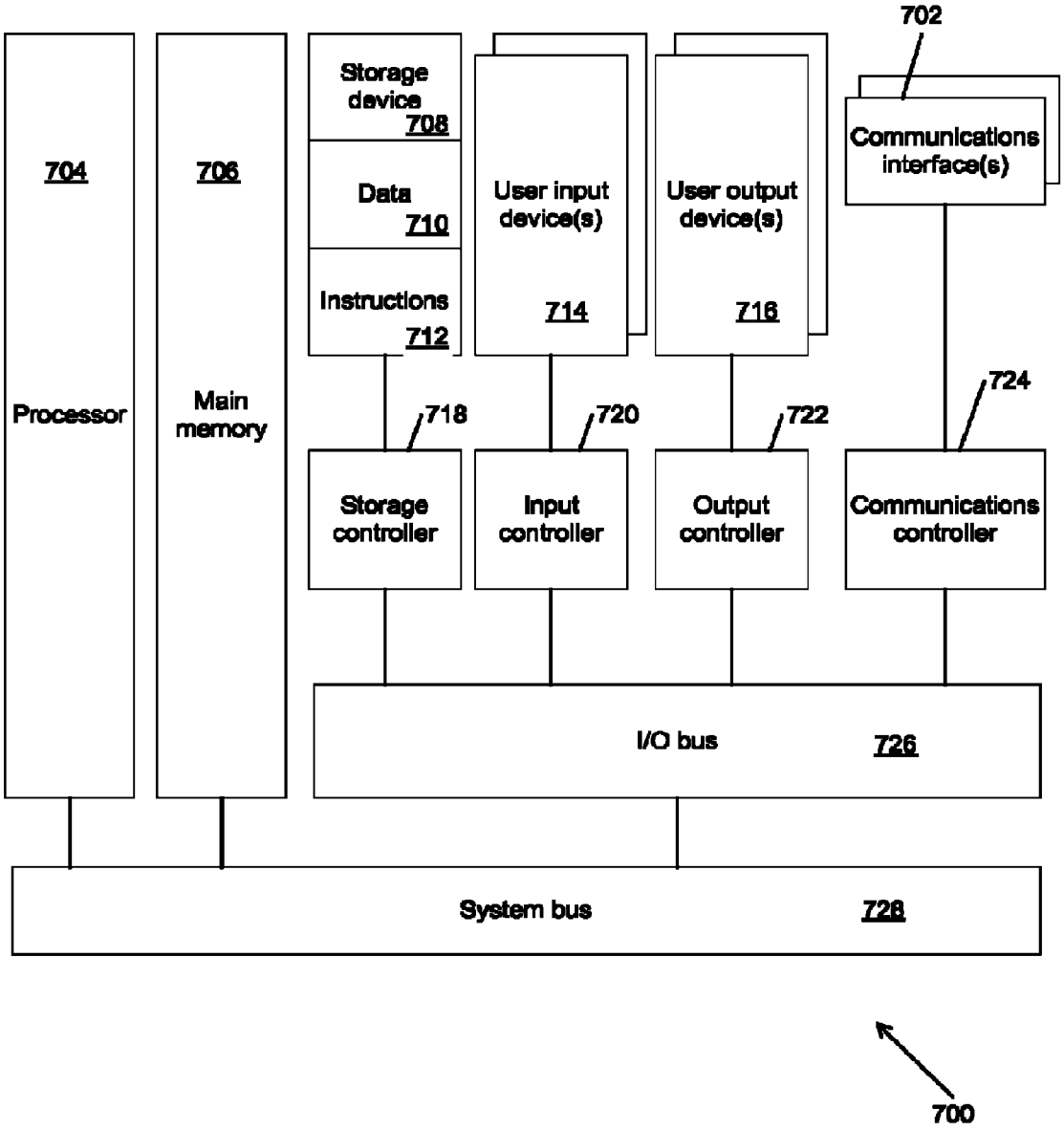
FIG. 7 illustrates a hardware architecture diagram of a processing apparatus in accordance with an embodiment of the invention.

Any of a variety of processing apparatuses can host various components of a skill normalized hybrid game in accordance with embodiments of the invention. In several embodiments, these processing apparatuses can include, but are not limited to, a gaming machine, a general purpose computer, a computing device and/or a controller. A processing apparatus that is constructed to implement a skill normalized hybrid game in accordance with an embodiment of the invention is illustrated in FIG. 7. In the processing apparatus 700, a processor 704 is coupled to a memory 706 by a bus 728. The processor 704 is also coupled to non-transitory processor-readable storage media, such as a storage device 708 that stores processor-executable instructions 712 and data 710 through the system bus 728 to an I/O bus 726 through a storage controller 718. The processor 704 is also coupled to one or more interfaces that may be used to connect the processor to other processing apparatuses as well as networks as described herein. The processor 704 is also coupled via the bus to user input devices 714, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 704 is connected to these user input devices 714 through the system bus 728, to the I/O bus 726 and through the input controller 720. The processor 704 is also coupled via the bus to user output devices 716 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 728 to the I/O bus 726 and through the output controller 722. The processor 704 can also be connected to a communications interface 702 from the system bus 728 to the I/O bus 726 through a communications controller 724.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, a GWE, ESE and skill normalization module as described herein can be implemented on multiple processing apparatuses, whether dedicated, shared or distributed in any combination thereof, or may be implemented on a single processing apparatus. In addition, while certain aspects and features of element management processes described herein have been attributed to an RWE, a GWE, an ESE or a skill normalization module these aspects and features may be implemented in a hybrid form where any of the features or aspects may be performed by any of a RWE, GWE, ESE or skill normalization module within a skill normalized hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A network distributed skill normalized hybrid gaming system, comprising:

a real world server connected to a game world server, wherein the real world server is constructed to provide a gambling game configured to provide a randomly generated payout for a wager of an amount of credits using a random number generator;

a controller connected to the game world server by a network, wherein the controller is constructed to execute an entertainment game providing an outcome upon a player's skillful execution of the entertainment game; and the game world server connecting the controller to the real world server by the network, wherein the game world server is constructed to:

communicate gameplay gambling event occurrences received from the controller to the real world server, wherein the gambling event occurrences are based upon the player's skillful execution of the entertainment game that trigger the wager of the amount of credits in the gambling game and generation of the randomly generated payout for the gambling game for the wager of the amount of credits;

determine player performance measurements for the player, the player performance measurements including the outcome of the player's skillful execution of the entertainment game and the amount of credits utilized by the player in the wager of the amount of credits as triggered in the gambling game;

assign a ranking to the player based at least in part upon the received player performance measurements;

assign a handicap to the player based at least in part upon the ranking and a ratio between the outcome of the player's skillful execution of the entertainment game and the amount of credits utilized by the player in the wager as triggered in the gambling game included in the performance measurements for the player from the game world server;

handicap the player by instructing the controller to implement the handicap against the player within the entertainment game executed by the controller; and generate a visual display indicating the handicap within the entertainment game.

2. The network distributed skill normalized hybrid gaming system of claim 1, wherein:

the player performance measurements further include results for the player against an opponent player; and the ranking is assigned to the player based upon the opponent player's rank and the player's results against the opponent player.

3. The network distributed skill normalized hybrid gaming system of claim 1, wherein:

the player performance measurements further include information on experience points earned by the player based upon game attributes; and the ranking is assigned to the player based upon the information on experience points earned by the player and an expected ranking based upon previously earned experience points by the player.

4. The network distributed skill normalized hybrid gaming system of claim 1, wherein the game world server is further constructed to determine that the player's performance measurements deviate from expected player performance measurements.

5. The distributed skill normalized hybrid gaming system of claim 4, wherein the determining that the player's performance measurements deviate from expected player performance measurements utilizes an outlier test.

6. The network distributed skill normalized hybrid gaming system of claim 5, wherein the outlier test is the Grubb's outlier test.

7. The network distributed skill normalized hybrid gaming system of claim 5, wherein the outlier test is the Dixon Q-test.

8. The network skill normalized hybrid game of claim 4, wherein the game world server is further constructed to adjust a player's handicap upon determining that the player's performance measurements deviate from expected player performance measurements.

9. The network distributed skill normalized hybrid gaming system of claim 4, wherein the expected player performance is based upon historical player performance measurements.

10. The network distributed skill normalized hybrid gaming system of claim 1, wherein the game world server and the real world server are constructed using a same processing apparatus.

* * * * *